US007789634B2

(12) United States Patent
Higashi et al.

(10) Patent No.: US 7,789,634 B2
(45) Date of Patent: Sep. 7, 2010

(54) COMPRESSOR

(75) Inventors: Hirofumi Higashi, Sakai (JP); Masanori Masuda, Sakai (JP); Katsumi Sakitani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1070 days.

(21) Appl. No.: 10/582,037

(22) PCT Filed: Dec. 10, 2004

(86) PCT No.: PCT/JP2004/018472

§ 371 (c)(1),
(2), (4) Date: Jun. 7, 2006

(87) PCT Pub. No.: WO2005/057010

PCT Pub. Date: Jun. 23, 2005

(65) Prior Publication Data

US 2007/0148025 A1 Jun. 28, 2007

(30) Foreign Application Priority Data

Dec. 11, 2003 (JP) ..... 2003-412795

(51) Int. Cl.
*F04B 39/10* (2006.01)

(52) U.S. Cl. ..... 417/297; 417/505; 137/856

(58) Field of Classification Search ..... None
See application file for complete search history.

(56) References Cited

U.S. PATENT DOCUMENTS

| | | | | |
|---|---|---|---|---|
| 4,432,311 | A * | 2/1984 | Holtzberg et al. | 123/90.67 |
| 4,516,406 | A * | 5/1985 | Gentry et al. | 62/183 |
| 2002/0157717 | A1 * | 10/2002 | Hong | 137/856 |

FOREIGN PATENT DOCUMENTS

| | | | |
|---|---|---|---|
| JP | 59-148436 | U | 10/1984 |
| JP | 61-138881 | U | 8/1986 |
| JP | 03-117619 | A | 5/1991 |
| JP | 04-275078 | A | 9/1992 |
| JP | 2000-249242 | A | 9/2000 |
| JP | 2002-330598 | A | 11/2002 |
| JP | 2002-332956 | A | 11/2002 |
| WO | WO-02-22492 | A2 | 3/2002 |

OTHER PUBLICATIONS

Notice of Reasons for Rejection of corresponding Japanese Application No. 2003-412795 dated Feb. 23, 2010.

* cited by examiner

*Primary Examiner*—Devon C Kramer
*Assistant Examiner*—Philip Stimpert
(74) *Attorney, Agent, or Firm*—Global IP Counselors

(57) ABSTRACT

A reed valve and a valve retainer for the reed valve are provided at a discharge port of a compression mechanism that compresses fluid. The valve retainer has a polymer actuator at an end part of a valve fixing part for fixing the reed valve. The polymer actuator expands or contracts in length to change a fixed length of the reed valve, thereby changing a rigidity of the reed valve. This attains appropriate control of responsiveness of the reed valve according to the volume.

4 Claims, 10 Drawing Sheets

COMPRESSOR

CROSS-REFERENCE TO RELATED APPLICATIONS

This U.S. National stage application claims priority under 35 U.S.C. §119(a) to Japanese Patent Application No. 2003-412795, filed in Japan on Dec. 11, 2003, the entire contents of which are hereby incorporated herein by reference.

TECHNICAL FIELD

The present invention relates to a compressor and particularly relates to countermeasures for reducing discharge pressure loss.

BACKGROUND ART

Conventionally, compressors are provided in, for example, air conditioners and have been used for compressing refrigerant in refrigerant circuits. In the compressors of this kind, there are known a rotary compressor of which hermetic casing accommodates a compression mechanism and an electric motor for driving the compression mechanism.

In the compression mechanism, a piston slews in a cylinder chamber by driving the electric motor. In association with the slewing motion, refrigerant at low pressure is sucked into a suction chamber through a suction port while refrigerant in a compression chamber becomes high pressure and is discharged into the inside of the casing through a discharge port.

Generally, a reed valve and a valve retainer for the reed valve are provided at the discharge port. When the compression chamber becomes a predetermined pressure or higher, the reed valve is warned at its valve body on the tip end side thereof to open the discharge port. When the refrigerant has been discharged from the compression chamber into the inside of the casing, the reed valve closes the discharge port by spring force of its own. The valve retainer fixes at the base end thereof the reed valve and restricts at the tip end thereof the valve body of the reed valve to a warp amount (a lift amount).

In the above compressor, the reed valve is warped largely especially in a high speed operation, namely, the lift amount of the reed valve becomes large, causing generally-called closing delay where the discharge port is not immediately closed when the compression chamber is exchanged from high pressure to low pressure. This causes the refrigerant at high pressure to flow back into the compression chamber from the inside of the casing, thereby lowering volumetric efficiency.

For tackling the above problem, Japanese Utility Model Registration Application Laid Open Publication No. 61-138881A, for example, proposes a valve retainer having a tip end part made of a bimetal. Specifically, the face portion at the tip end of the valve retainer on the opposite side to the reed valve side is made of a bimetal. In this compressor, the discharge temperature of the refrigerant rises as the operation speed is increased. The bimetal is warped in a direction separating from the discharge port in association with increase in discharge temperature. This changes the reed valve supporting state of the valve retainer to increase the spring constant (spring force) of the reed valve, allowing the reed valve to start closing earlier. As a result, the closing delay of the reed valve in a high speed operation is suppressed.

—Problems to be Solved—

However, in the above compressor, the valve retainer is warped depending only on change in discharge temperature, resulting in less reliability. Further, the lift amount of the reed valve is difficult to adjust in response to the discharge rate, inviting discharge pressure loss. In view of the foregoing, it has been desired to change the opening/closing state of the reed valve appropriate to the volume.

The present invention has been made in view of the foregoing and has its object of improving operation efficiency by controlling the opening/closing state of the reed valve appropriately to the volume.

SUMMARY OF THE INVENTION

The means that the present invention provides are as follows.

A compressor pertaining to a first aspect of the present invention is a compressor that includes: a compression mechanism (20) configured to compress fluid, the compression mechanism including a discharge port; a reed valve (41); and a valve retainer (42) for the reed valve (41), coupling the reed valve (41) at the discharge port (29). At least part of the valve retainer (42) is composed of a shape varying member (50) that varies in shape in response to an external input force so as to change an opening/closing state of the reed valve (41).

In the first aspect of the present invention, the opening/closing state of the reed valve (41) is changed appropriately to the operation speed (volume) by controlling shape variation of the shape varying member (50). For example, when the lift amount of the reed valve (41) is changed by shape variation of the shape varying member (50), the opening of the reed valve (41) is set appropriately to a discharge rate. This reduces discharge pressure loss and the like.

Further, when the rigidity of the reed valve (41) is changed by shape variation of the shape varying member (50), the reed valve (41) is set to have opening/closing force appropriate to the discharge rate. This enhances opening/closing responsiveness of the reed valve (41), suppressing generally-called closing delay. As a result, operation efficiency is improved.

A second aspect of the present invention is the compressor according to the first aspect of the present invention, wherein the valve retainer (42) includes a valve fixing part (42*a*) for fixing a fixed part (41*a*) of the reed valve (41) and a curved guiding part (42*b*) for restricting a valve part (41b) of the reed valve (41) to a lift amount. Further, at least part of the guiding part (42*b*) is composed of the shape varying member (50) so as to change the lift amount of the valve part (41*b*) of the reed valve (41).

In the second aspect of the present invention, the shape varying member (50) of the guiding member (42*b*) of the valve retainer (42) is varied in shape to change at least the lift amount of the valve part (41*b*) of the reed valve (41), thereby changing the opening/closing state of the reed valve (41) reliably.

A third aspect of the present invention is the compressor according to the second aspect of the present invention, wherein the shape varying member (50) of the guiding part (42*b*) changes in a warp amount so as to change a curve.

In the third aspect of the present invention, the warp amount of the shape varying member (50) is changed to change the curve of the guiding part (42*b*), thereby changing the lift amount of the valve part (41*b*) of the reed valve (41).

A fourth aspect of the present invention is the compressor according to the first aspect of the present invention, wherein the valve retainer (42) includes a valve fixing part (42*a*) for fixing a fixed part (41*a*) of the reed valve (41) and a curved guiding part (42*b*) for restricting a valve part (41*b*) of the reed valve (41) to a lift amount. Further, at least part of the valve fixing part (42*a*) forms the shape varying member (50) so as to change a rigidity of the reed valve (41).

In the fourth aspect of the present invention, the shape varying member (50) of the valve fixing part (42*a*) of the valve retainer (42) varies in shape to change at least the rigidity of the reed valve (41), thereby changing the opening/closing state of the reed valve (41) reliably.

A fifth aspect of the present invention is the compressor according to the fourth aspect of the present invention, wherein the shape varying member (50) of the valve fixing part (42*a*) expands or contracts in length so as to change a fixed length of the reed valve (41).

In the fifth aspect of the present invention, the shape varying member (50) is allowed to expand or contract to change the fixed length of the reed valve (41), thereby changing the rigidity of the reed valve (41).

A sixth aspect of the present invention is the compressor according to the first aspect of the present invention, wherein the shape varying member (50) is formed of a polymer actuator.

In the sixth aspect of the present invention, the shape varying member (50) is formed of the polymer actuator (50), resulting in reliable change in opening/closing state of the reed valve (41).

In the first aspect of the present invention, at least part of the valve retainer (42) is formed of the shape varying member (50) to change the opening/closing State of the reed valve (41). Accordingly, the shape variation of the shape varying member (50) can be controlled in response to the operation speed over the range from low speed to high speed, enabling appropriate control of the opening/closing state of the reed valve (41), for example, the lift amount, responsiveness, or the like thereof in response to the operation speed. This suppresses discharge pressure loss, which is caused due to lift amount, and opening/closing delay, which is caused due to responsiveness. As a result, the operation efficiency is improved.

Further, shape variation only of the shape varying member (50) can attain change in opening/closing state of the reed valve (41). Therefore, less shape varying force is required and the operation efficiency is further improved.

In the second aspect of the present invention, at least part of the guiding part (42*b*) of the valve retainer (42) is formed of the shape varying member (50) to change the lift amount of the valve part (41*b*) of the reed valve (41). This attains appropriate and reliable control of at least the lift amount of the reed valve (41) in response to the operation speed, thereby surely reducing the discharge pressure loss.

Furthermore, even in a low speed operation, the valve part (41*b*) of the reed valve (41) is in contact with and is secured to the valve retainer (42) reliably in refrigerant discharge, similarly to in the high speed operation by the conventional compressor, suppressing vibration of the reed valve (41). This stabilizes behavior of the reed valve (41), attaining a compressor-friendly operation.

In the third aspect of the present invention, the warp amount of the shape varying member (50) is changed to change the curve of the guiding part (42*b*) of the valve retainer (42), changing the lift amount of the reed valve (41) reliably.

In the fourth aspect of the present invention, at least part of The valve fixing part (42*a*) of the valve retainer (42) is formed of the shape varying member (50) to change the rigidity of the reed valve (41). Therefore, at least the rigidity of the reed valve (41), that is, opening/closing force can be controlled appropriately and reliably in response to the operation speed. This enhances the responsiveness at closing start with the increased opening/closing force in the high speed operation while enhancing responsiveness at opening start with the decreased opening/closing force in the low speed operation. As a result, the generally-called closing delay and opening delay of the reed valve (41) can be suppressed, improving efficiency.

In the fifth aspect of the present invention, the shape varying member (50) is allowed to expand or contract to change the fixed length of the reed valve (41), thereby changing the rigidity of the reed valve (41) reliably.

In the sixth problem solving means, the shape varying member (50) is formed of the polymer actuator (50), resulting in reliable change in opening/closing state of the reed valve (41).

DETAILED DESCRIPTION OF THE INVENTION

Embodiments of the present invention will be described below in detail with reference to the drawings.

Embodiment 1 of the Invention

Figure 1:
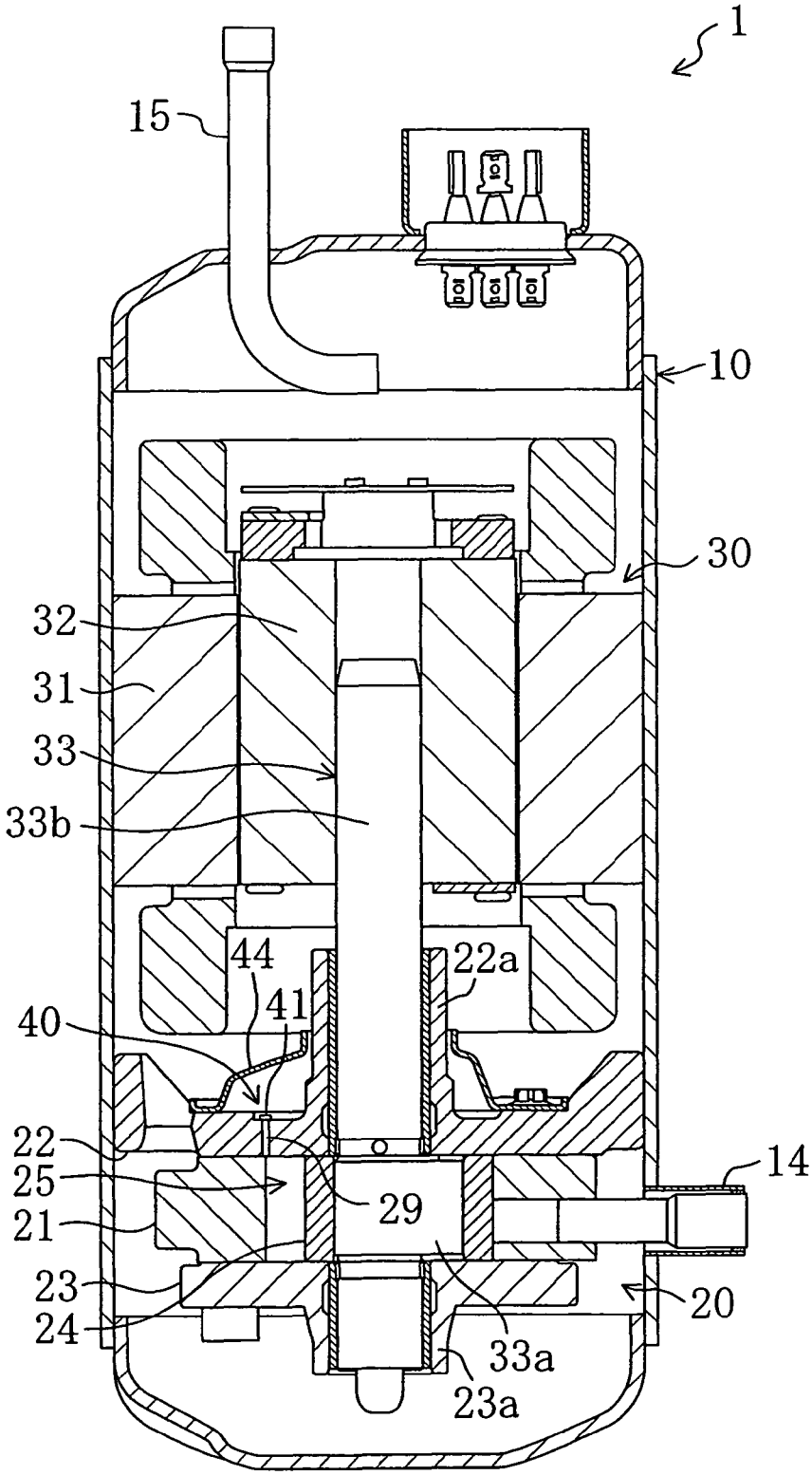
FIG. 1 is a section showing a construction of a rotary compressor according to embodiments.
Figure 2:
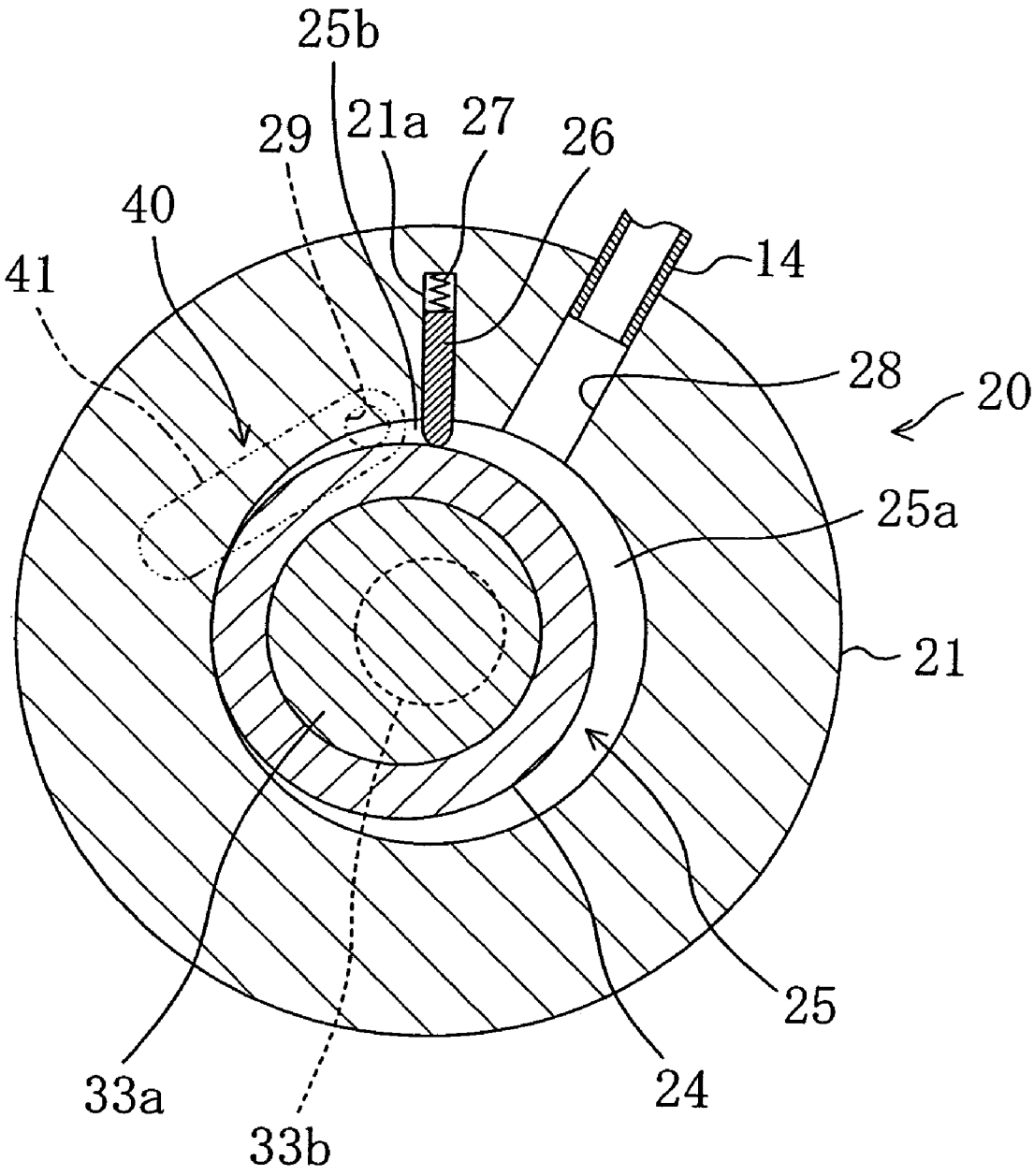
FIG. 2 is a transverse section showing a compression mechanism according to the embodiments.

A compressor in Embodiment 1 is generally called a rotary compressor (1) of rotary piston type (hereinafter referred to merely as "a compressor"), as shown in FIG. 1 and FIG. 2. A compression mechanism (20) and an electric motor (30) for driving the compression mechanism (20) are accommodated in a hermetic dome casing (10) of the compressor (1). The compressor (1) is variable in volume continuously or step by step by inverter-controlling the electric motor (30). In the compressor (1), the electric motor (30) drives the compression mechanism (20) to cause suction, compression, and then, discharge of, for example, refrigerant for circulating it in a refrigerant circuit.

A suction pipe (14) is provided at the lower part of the casing (10), and a discharge pipe (15) is provided at the upper part thereof.

The compression mechanism (20) includes a cylinder (21), a front head (22), a rear head (23), and a piston (24), wherein the front head (22) is fixed to the upper end of the cylinder (21) and the rear head (23) is fixed to the lower end thereof.

The cylinder (21) is formed to have a thick cylindrical shape. The inner peripheral face of the cylinder (21), the lower end face of the front head (22), and the upper end face of the rear head (23) define and form a column-shaped cylinder chamber (25). The cylinder chamber (25) allows the piston (24) to perform a rotation operation in the cylinder chamber (25).

The electric motor (30) includes a stator (31) and a rotor (32). A drive shaft (33) is connected to the rotor (32). The drive shaft (33) is arranged at the center of the casing (10) and passes through the cylinder chamber (25) vertically. Bearing portions (22*a*, 23*a*) are formed in the front head (22) and the rear head (23), respectively, for supporting the drive shaft (33).

The drive shaft includes a main body (33*b*) and an eccentric portion (33*a*) located in the cylinder chamber (25). The eccentric portion (33*a*) has a diameter larger than the main body (33*b*) and is eccentric by a predetermined amount from the center of rotation of the drive shaft (33). The eccentric portion (33*a*) is fitted in the piston (24) of the compression mechanism (20). As shown in FIG. 2, the piston (24) has an annular shape and is substantially in point-contact at the outer peripheral face thereof with the inner peripheral face of the cylinder (21).

In the cylinder (21), a blade groove (21*a*) is formed in the radial direction of the cylinder (21). A blade (26) in a rectangular plate shape is fitted in the blade groove (21*a*) slidably in the radial direction of the cylinder (21). The blade (26) is biased inwardly of the radial direction by a spring (27) provided in the blade groove (21*a*) so as to be always in contact at the tip end thereof with the outer peripheral face of the piston (24).

The blade (26) divides the cylinder chamber (25) formed between the inner peripheral face of the cylinder (21) and the outer peripheral face of the piston (24) into a suction chamber (25*a*) and a compression chamber (25*b*). A suction port (28) is formed in the cylinder (21) so as to pass through the cylinder (21) in the radial direction from the outer peripheral face to the inner peripheral face of the cylinder (21) and so as to allow the suction pipe (14) and the suction chamber (25*a*) to communicate with each other. A discharge port (29) is formed in the front head (22) so as to pass therethrough along the axial direction of the drive shaft (33) and so as to allow the compression chamber (25*b*) and a space in the casing (10) to communicate with each other.

In the front head (22), a discharge valve mechanism (40) is provided for opening/closing the discharge port (29). A muffler (44) covers the upper face of the front head (22).

Figure 3:
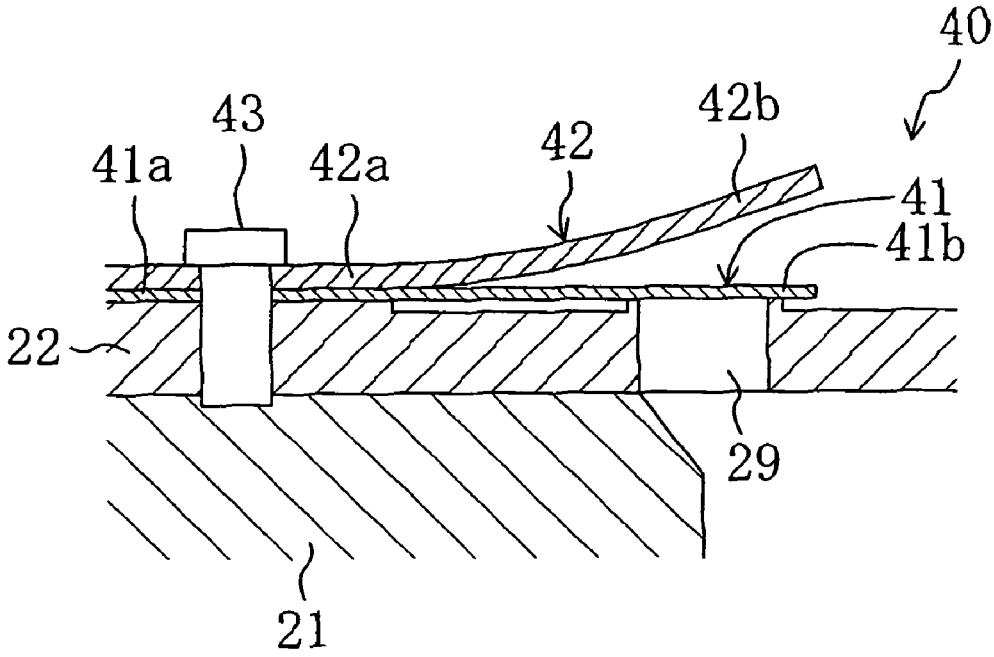
FIG. 3 is an enlarged section showing a discharge valve mechanism according to the embodiments.

As shown in FIG. 3, the discharge valve mechanism (40) includes a reed valve (41) and a valve retainer (42). The valve retainer (42) is laid over the reed valve (41) that the reed valve (41) is interposed between the front head (22) and the valve retainer (42). The read valve (41) and the valve retainer (42) are fixed at the base ends thereof to the front head (22) by means of a screw bolt (43).

The valve retainer (42) includes a valve fixing part (42*a*) in a flat plate shape as a base end part thereof and a curved guiding part (42*b*) as a tip end part thereof. The valve fixing part (42*a*) fixes a fixing part (41*a*), which is a base end part of the reed valve (41), and the guiding part (42*b*) is continuously formed from the valve fixing part (42*a*) and restricts a valve part (41*b*), which is a tip end part of the reed valve (41), to a warp amount (a lift amount). Specifically, the reed valve (41) is so composed that: when the pressure of the compression chamber (25*b*) of the cylinder chamber (25) is a predetermined value, the valve part (41*b*) is warped along the guiding part (42*b*) of the valve retainer (42) to open the discharge port (29), so that gas refrigerant at high pressure is discharged from the compression chamber (25*b*) into the inside of the casing (10); and when the pressure of the compression chamber (25*b*) becomes low by the gas refrigerant discharge, the valve part (41*b*) closes the discharge port (29) by spring force that the reed valve (41) has inherently.

Figure 4A:
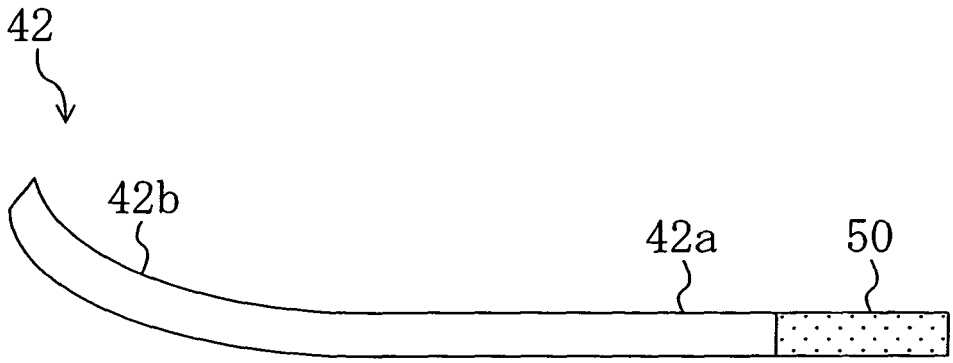
FIG. 4 is a set of configuration diagrams schematically showing a structure of a valve retainer according to Embodiment 1, wherein FIG. 4(*a*) and FIG. 4(*b*) are a side view and a plan view, respectively.
Figure 4B:
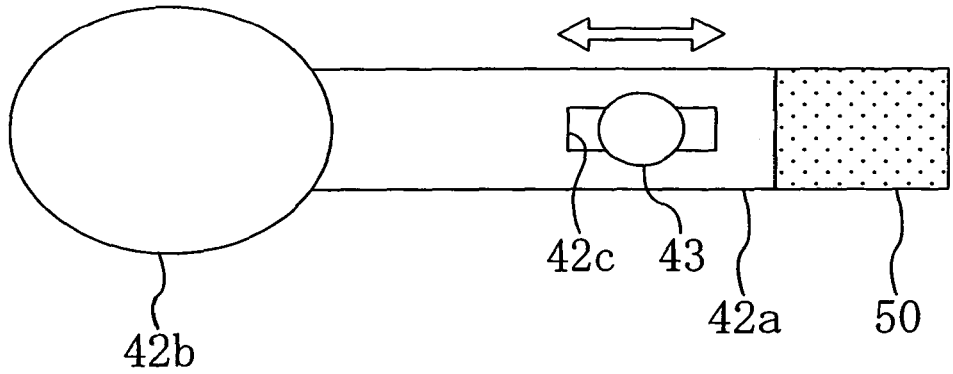
Figure 5:
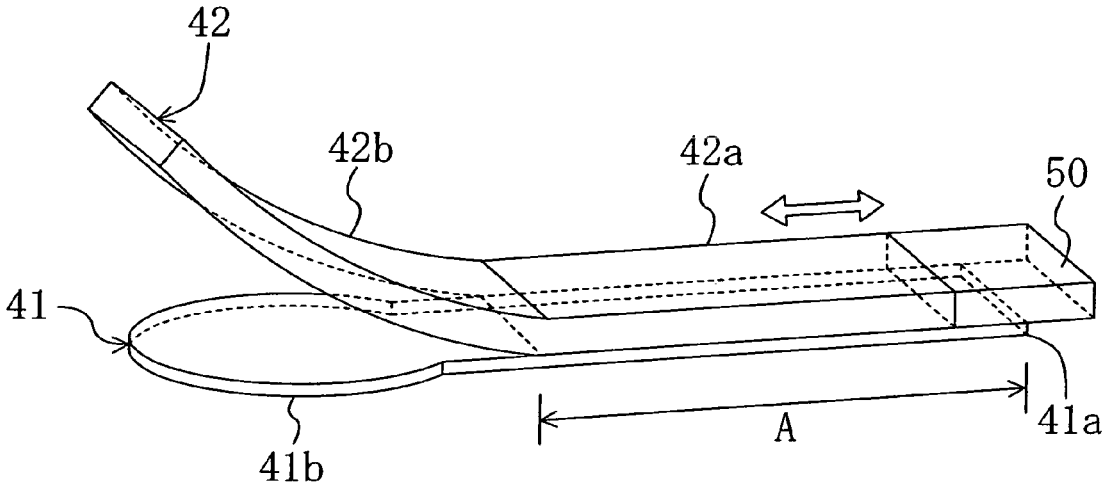
FIG. 5 is a perspective view showing a reed valve and the valve retainer according to Embodiment 1.

Referring to one of significant features of the present invention, as shown in FIG. 4 and FIG. 5, part on the end side of the valve fixing part (42*a*) of the valve retainer (42) is formed of a polymer actuator (50). The polymer actuator (50) serves as a shape varying member that varies in shape by external input force such as voltage application.

Figure 6:
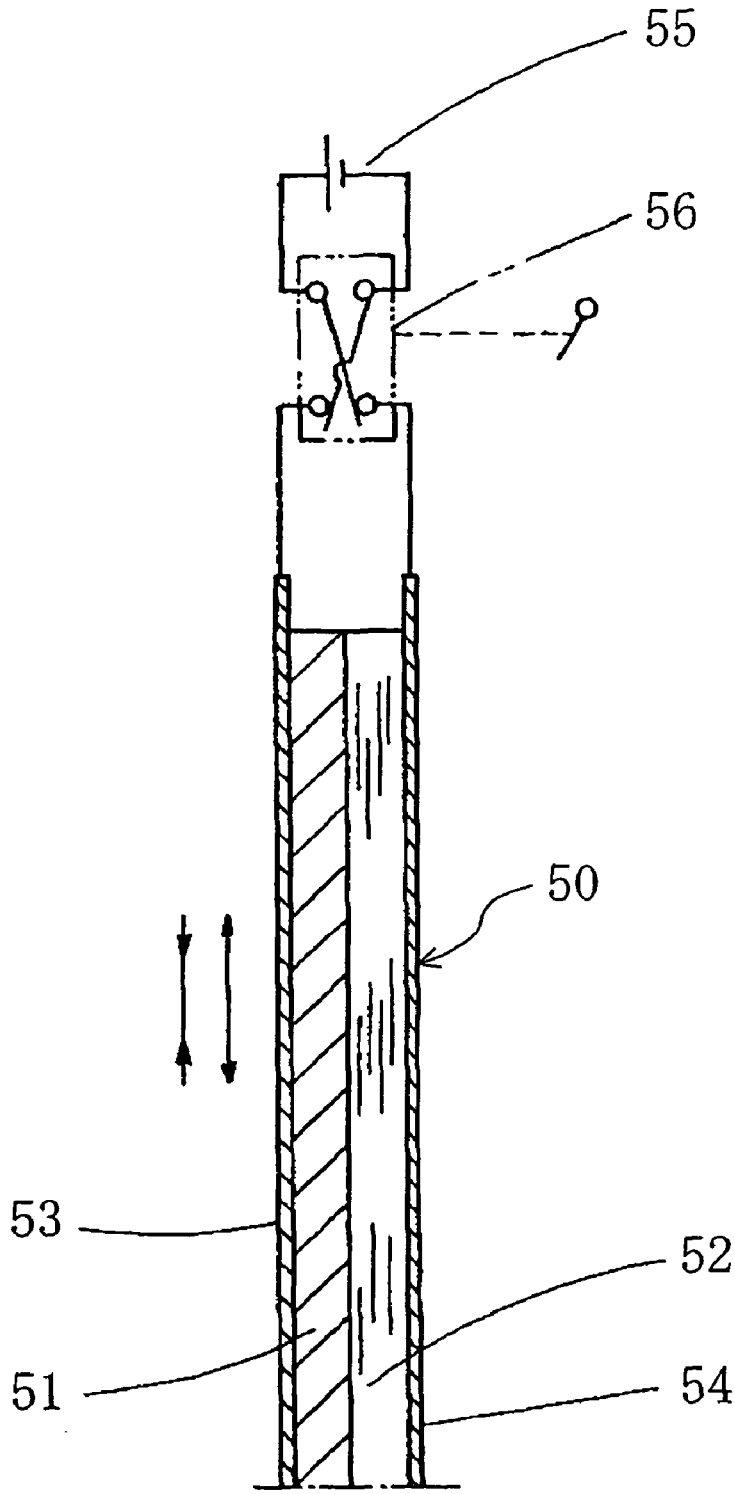
FIG. 6 is a configuration diagram showing a main part of a polymer actuator according to Embodiment 1.

The polymer actuator (50) is made of a conductive polymer actuator, as shown in FIG. 6. The polymer actuator (50) has expanding/contracting property through voltage application. In the polymer actuator (50), a polymer member (51) of, for example, "polyaniline" or the like and an electrolytic solution (52) are arranged in contact with each other, an electrode (53) is provided outside the polymer member (51), and another electrode (54) is provided outside the electrolytic solution (52). A protection coating of a resin film or the like is provided outside each of the electrodes (53, 54). A direct current source (55) is connected to each of the electrodes (53, 54) through a switch (56). Each polarity of the electrodes (53, 54) is changed appropriately by operating the switch (56) so as to allow polymer actuator (50) to expand or contract as indicated by the open arrow in FIG. 5.

Specifically, when the electrodes (53, 54) are set to serve as "a positive pole" and "a negative pole," respectively, "an anion" in the electrolytic solution (52) is caught in the polymer member (51) to swell the polymer member (51), resulting in expansion in length of the polymer member (51). In reverse, when the electrodes (53, 54) are set to serve as "the negative pole" and "the positive pole," respectively, the "anion" caught in the polymer member (51) is released to the electrolytic solution (52) to cause contraction of the polymer member (51). Thus, the polymer actuator (50) expands or contracts through change in polarity of the applied voltage.

The polymer actuator (50) has property of maintaining, even after voltage application stops after expansion or contraction by the voltage application, the expansion or contraction state before the voltage application stops. Accordingly, voltage is applied to the polymer actuator (50) only for expansion or contraction. This property is significantly different from property that requires continuous heating for maintaining its original shape after shape recovery, such as shape memory alloy.

Figure 7:
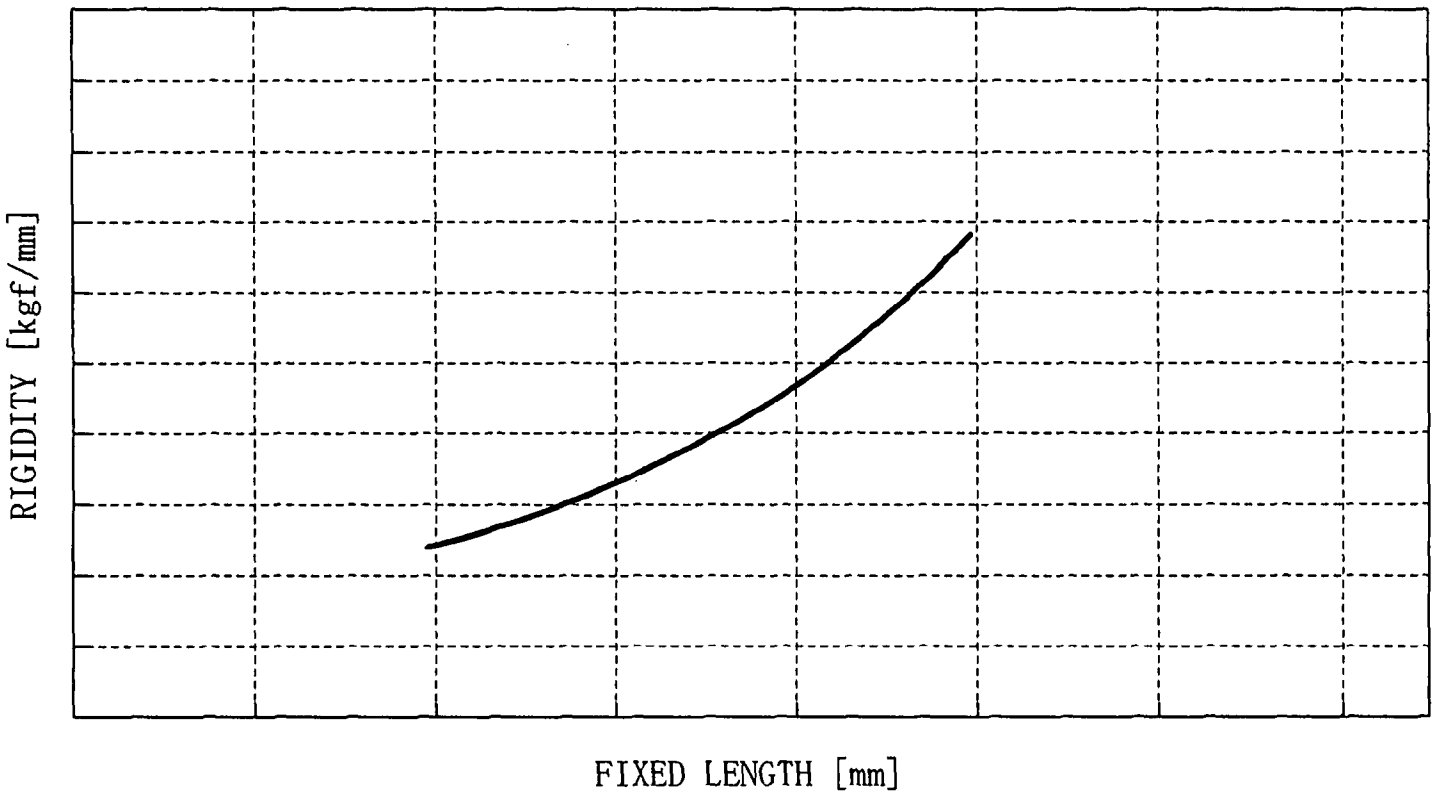
FIG. 7 is a graph showing the relationship between fixed length and rigidity of the reed valve.

As shown in FIG. 5, the polymer actuator (50) expands or contracts in the longitudinal direction of the valve retainer (42) to change the length of valve fixing part (42*a*), thereby changing a fixed length (A) of the reed valve (41), a length of a range where the reed valve (41) is fixed to the valve fixing part (42*a*). When the fixed length (A) becomes great, the reed valve (41) increases in its rigidity (spring force), and vise versa (see FIG. 7). In short, expansion or contraction of the polymer actuator (50) changes the rigidity (spring force) of the reed valve (41). A long hole (42*c*) as a mounting hole for mounting the screw bolt (43) is formed in the valve fixing part (42*a*) of the valve retainer (42). The valve fixing part (42*a*) is capable of sliding along the long hole (42*c*) in response to expansion or contraction of the polymer actuator (50).

For example, when the polymer actuator (50) is allowed to expand, the fixed length (A) of the reed valve (41) becomes greater as the valve fixing part (42*a*) of the valve retainer (42) becomes longer, increasing the rigidity of the reed valve (41). This increases closing force and closing speed of the valve part (41*b*) of the reed valve (41). In contrast, when the polymer actuator (50) is allowed to contract, the fixed length (A) of the reed valve (41) becomes smaller as the valve fixing part (42*a*) of the valve retainer (42) becomes shorter, reducing the rigidity of the reed valve (41). This reduces force required for opening the valve part (41*b*) of the reed valve (41) and increases opening speed. Thus, the valve retainer (42) changes the opening/closing state of the reed valve (41) through expansion or contraction of the polymer actuator (50).

It is noted that in the present embodiment, the end part of the valve fixing part (42*a*) of the valve retainer (42) is formed of the polymer actuator (50), but the central part, part on the guiding part (42*b*) side, or the entirety of the valve fixing part (42*a*) may be formed of the polymer actuator (50). Namely, the polymer actuator (50) may be employed in any part of the valve fixing part (42*a*) only within a range capable of changing the fixed length of the reed valve (41) through at least expansion or contraction in length of its own.

—Driving Operation—

A driving operation of the above described compressor (1) will be described next.

First, when the electric motor (30) is electrified, the rotor (32) rotates and the rotation of the rotor (32) is transmitted to the piston (24) of the compression mechanism (20) through the drive shaft (33) to cause the compression mechanism (20) to perform a predetermined compression operation.

The compression operation of the compression mechanism (20) will be described in detail with reference to FIG. 2. When the piston (24) rotates right (clockwise) by driving the electric motor (30), the volume of the suction chamber (25*a*) increases in association with the rotation, so that the refrigerant at low pressure is sucked into the suction chamber (25*a*) through the suction port (28). The suction of the refrigerant to the suction chamber (25*a*) continues until the piston (24) rotates in the cylinder chamber (25) to be in the state where the piston (24) is in contact again with the cylinder (21) on the immediately right side of the suction port (28).

When the refrigerant suction terminates by one rotation (of the piston (24), as described above, the compression chamber (25*b*) is formed where the refrigerant is compressed. A new suction chamber (25*a*) is formed next to the compression chamber (25*b*) and the refrigerant suction into the suction chamber (25*a*) is repeated. The refrigerant in the compression chamber (25*b*) is compressed by volume decrease of the compression chamber (25*b*) as the piston (24) rotates. When the pressure of the refrigerant becomes a predetermined high value, the valve part (41*b*) of the reed valve (41) is warped and opens, so that the refrigerant is discharged from the compression chamber (25*b*) into the inside of the casing (10) through the discharge port (29). Thereafter, when the pressure of the compression chamber (25*b*) becomes low by the discharge of the refrigerant at high pressure, the valve part (41*b*) of the reed valve (41) closes the discharge port (29) by the rigidity (spring force) of its own. The suction, compression, and discharge of the refrigerant are repeated in this way.

Wherein, in a high speed operation, for example, a refrigerant discharge rate is great, and therefore, the lift amount (warp amount) of the valve part (41*b*) of the reed valve (41) increases. When the polymer actuator (50) is allowed to expand at that time, the rigidity of the reed valve (41) increases and the closing force and the closing speed of the valve part (41*b*) of the reed valve (41) also increase. Accordingly, the valve part (41*b*) starts closing immediately after exchange of the compression chamber (25*b*) from high pressure to low pressure upon completion of the refrigerant discharge, and completes closing of the discharge port (29) swiftly. In other words, the responsiveness at closing start of the reed valve (41) is enhanced. This suppresses generally-called closing delay of the reed valve (41), preventing back flow of the refrigerant at high pressure within the casing (10) into the compression chamber (25*b*). The refrigerant flows at a high rate and has great energy at opening start of the reed valve (41), and accordingly, sufficient responsiveness is ensured even with increased rigidity of the reed valve (41).

On the other hand, in a low speed operation, the discharge rate is low, and therefore, the refrigerant has less energy. In this operation, when the polymer actuator (50) is allowed to contract, the rigidity of the reed valve (41) decreases and force required for opening the valve part (41*b*) of the reed valve (41) decreases while opening speed thereof increases. This leads to immediate opening of the valve part (41*b*) and quick opening of the valve part (41*b*) to a predetermined lift amount immediately after the compression chamber (25*b*) becomes the predetermined high pressure even through the refrigerant has less energy. Namely, the responsiveness of the reed valve (41) at opening start is enhanced. As a result, the discharge pressure loss is reduced. It is noted that the flow rate of the refrigerant is low and the refrigerant has less energy at closing start of the reed valve (41), and therefore, sufficient responsiveness is ensured even with the decreased rigidity of the reed valve (41).

As described above, expansion or contraction of the polymer actuator (50) in response to the operation speed (volume) attains appropriate control of the opening/closing force of the reed valve (41), enhancing the opening/closing responsiveness of the reed valve (41). In other words, the polymer actuator (50) controls the opening/closing state of the reed valve (41) appropriately to the operation speed.

Effects Of Embodiment

As described above, in the present embodiment, part of the valve fixing part (42*a*) of the valve retainer (42) is formed of the polymer actuator (50) for changing the rigidity of the reed valve (41), so that the opening/closing state of the reed valve (41) is changed. This enables control of the opening/closing force of the reed valve (41) to enhance the opening/closing responsiveness of the reed valve (41). Hence, the responsiveness at closing start of the reed valve (41) is enhanced in the high speed operation, suppressing the closing delay. Also, the responsiveness at opening start of the reed valve (41) is enhanced in the low speed operation, reducing the discharge pressure loss. As a result, operation efficiency is improved.

Particularly, the rigidity of the reed valve (41) can be changed in response to the operation speed over the range from low speed to high speed, attaining easy control of the opening/closing responsiveness of the reed valve (41) at multistage.

Further, expansion or contraction only of the polymer actuator (50) attains change in the fixed length of the reed valve (41) to change the rigidity of the reed valve (41), requiring less shape varying force and improving the efficiency.

Embodiment 2 of the Invention

Embodiment 2 of the present invention will be described next with reference to the drawings.

Figure 8A:
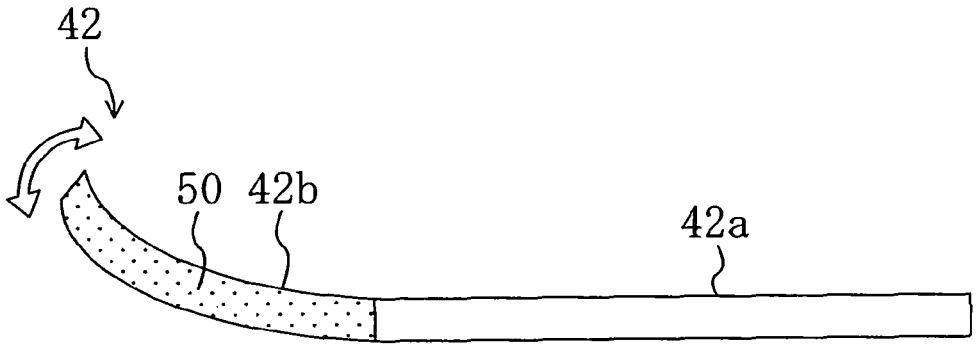
FIG. 8 is a set of configuration diagrams schematically showing a valve retainer according to Embodiment 2, wherein FIG. 8(*a*) and FIG. 8(*b*) are a side view and a plan view, respectively.
Figure 8B:
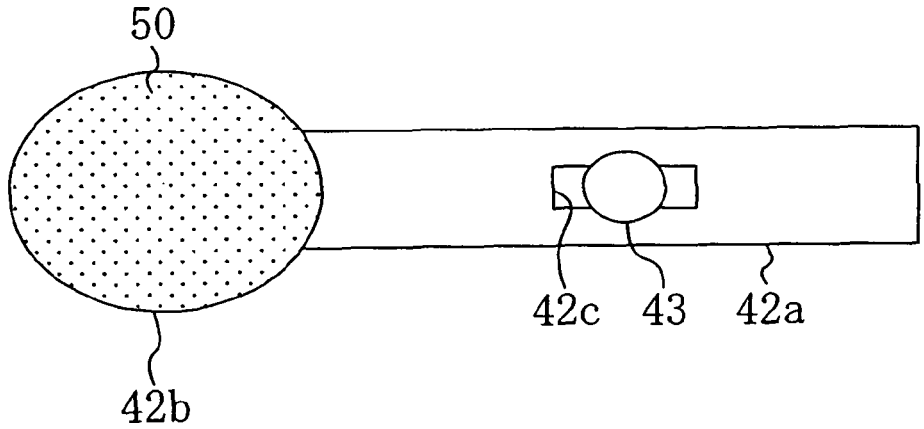
Figure 9:
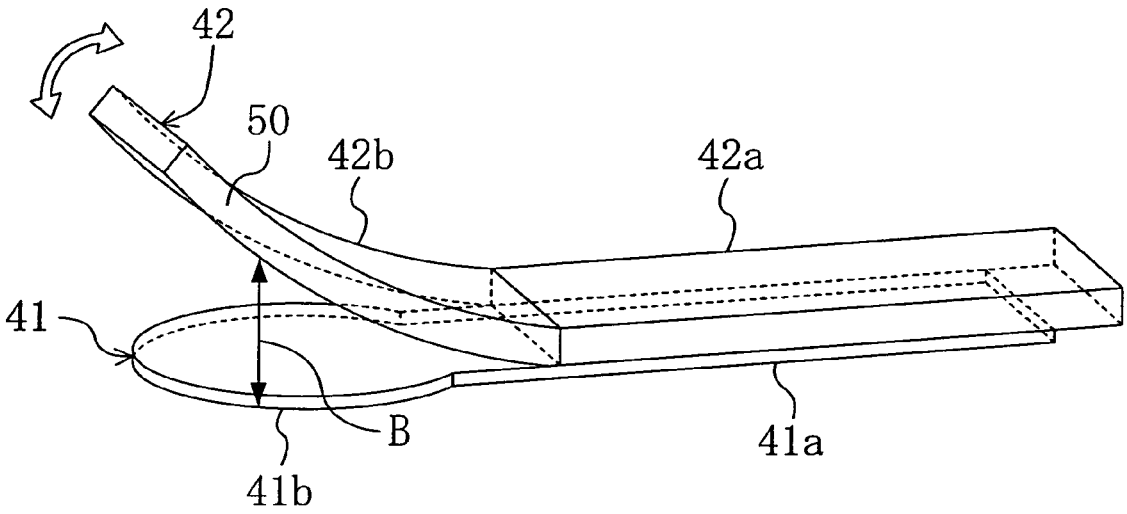
FIG. 9 is a perspective view showing a reed valve and the valve retainer according to Embodiment 2.

In Embodiment 2, as shown in FIG. 8 and FIG. 9, the guiding part (42*b*) of the valve retainer (42) is formed of a polymer actuator (50), which is the difference from Embodiment 1 in which the valve fixing part (42*a*) of the valve retainer (42) is formed of the polymer actuator (50).

The valve retainer (42) has the guiding part (42*b*) of which entirety is formed of the polymer actuator (50). The polymer actuator (50) is an ion conduction actuator, as shown in FIG. 10, which is the difference from the Embodiment 1.

The polymer actuator (50) has property of being warped through voltage application. In the polymer actuator (50), electrodes (53, 54) are provided on the respective faces of a hydrous polymer electrolyte (27). A protection coating of a resin film or the like is provided outside each of the electrodes (53, 54). The direct current source (55) is connected to each of the electrodes (53, 54) through the switch (56). Each polarity of the electrodes (53, 54) is changed appropriately by operating the switch (56) so as to allow the polymer actuator (50) to be warped and vary in shape as indicated by the open arrow in FIG. 9.

Figures 10A, 10B:
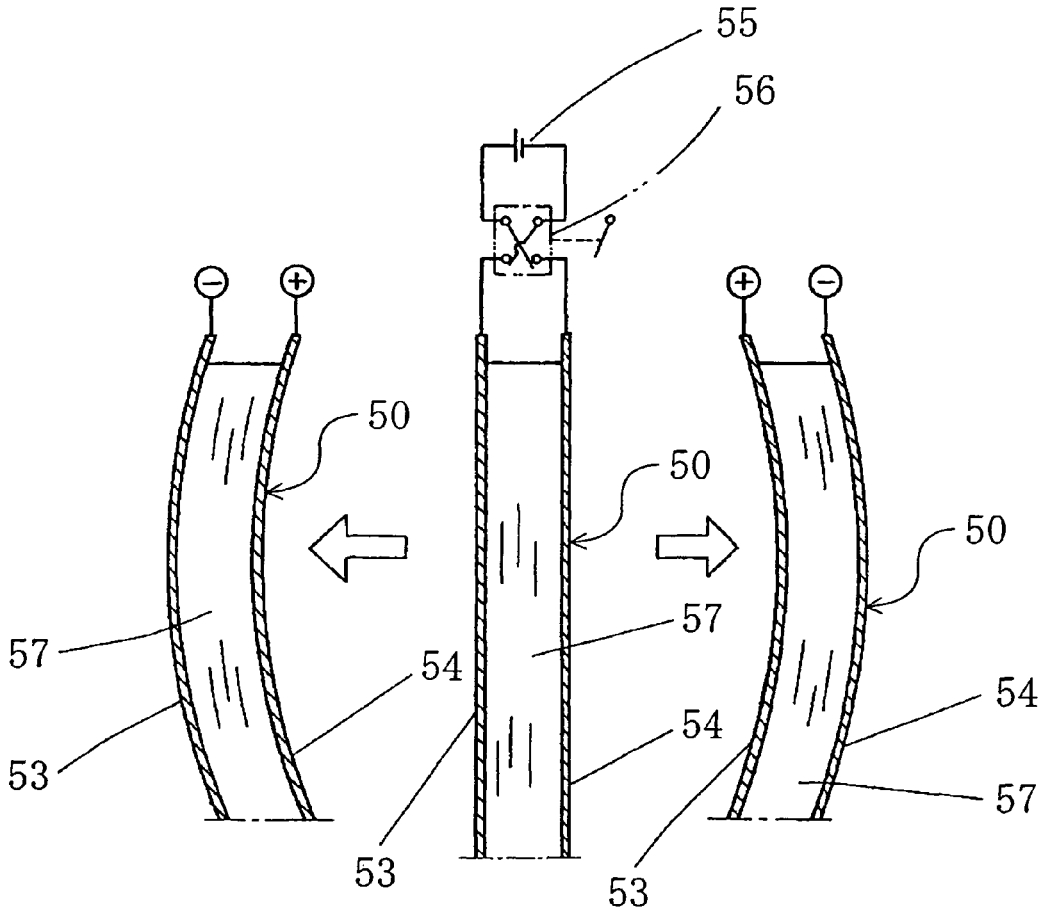
FIG. 10 is a configuration diagram showing a main part of a polymer actuator according to Embodiment 2.

Specifically, as shown in FIG. 10(*a*), when the electrodes (53, 54) are set to serve as "a negative pole" and "a positive pole," respectively, "a cation" in the hydrous polymer electrolyte (57) moves accompanying water towards "the negative pole" to cause maldistribution of the water content to "the negative pole" side. This causes difference in swelling between "the negative pole" and "the positive pole," thereby allowing the polymer actuator (50) to be warped and curved towards "the negative pole," that is, the electrode (53). In reverse, as shown in FIG. 10(*b*), when the electrodes (53, 54) are set to serve as "the positive pole" and "the negative pole," respectively, "cation" in the hydrous polymer electrolyte (57) moves accompanying water towards "the negative pole" to allow the polymer actuator (50) to be warped and curved towards "the negative pole," that is, the electrode (54). In this way, the polymer actuator (50) is warped through change in polarity of the applied voltage.

Similarly to Embodiment 1, the polymer actuator (50) has property of maintaining, even after voltage application stops after warp towards a predetermined side by the voltage application, the warped state before the voltage application stops. Accordingly, voltage is applied to the polymer actuator (50) only for warp. The polymer actuator (50) has property of generating necessary shape varying force in warp towards any sides.

As shown in FIG. 9, the polymer actuator (50) changes the warp amount in shape variation to change the curve of the guiding part (42*b*), thereby changing the lift amount (B) of the valve part (41*b*) of the reed valve (41). In other words, the polymer actuator (50) is warped and varies in shape to adjust an allowable lift amount of the reed valve (41).

For example, when the warp amount of the polymer actuator (50) is increased, the guiding part (42*b*) of the valve retainer (42) curves greatly and varies in shape in the direction separating from the discharge port (29). This increases the warp amount of the valve part (41*b*) of the reed valve (41), increasing the allowable lift amount (B) of the reed valve (41). In reverse, when the warp amount of the polymer actuator (50) is decreased, the guiding part (42*b*) of the valve retainer (42) curves less and varies in shape in the direction where the guiding part (42*b*) approaches the discharge port (29). This reduces the allowable lift amount (B) of the reed valve (41). Thus, the valve retainer (42) changes the opening/closing state of the reed valve (41) through warp and shape variation of the polymer actuator (50).

In the above constitution, when the warp amount of the polymer actuator (50) is increased in, for example, the high speed operation, the lift amount of the reed valve (41) increases, ensuring passage area according to the discharge rate. This suppresses flow resistance of the discharged refrigerant, reducing the discharge pressure loss even at increase in discharge rate. As a result, the operation efficiency is improved.

In contrast, in the low speed operation, when the warp amount of the polymer actuator (50) is decreased, the allowable lift amount of the reed valve (41) decreases so that the valve part (41*b*) of the reed valve (41) is reliably in contact with and is secured to the guiding part (42*b*) in refrigerant discharge. This prevents vibration of the valve part (41*b*) of the reed valve (41), which is caused due to refrigerant flow, even when the lift amount of the reed valve (41) is decreased by decrease in discharge rate. Thus, the behavior of the reed valve (41) is stabilized. As a result, noise reduction and a compressor-easy operation are attained.

As described above, adjustment of the warp amount of the polymer actuator (50) in response to the operation speed (volume) attains appropriate control of the lift amount of the reed valve (41). In other words, warp and shape variation of the polymer actuator (50) attains control of the reed valve (41) to an appropriate opening/closing state in response to the operation speed. The other construction, operation, and effects are the same as those in Embodiment 1.

It is noted that the entirety of the guiding part (42*b*) of the valve retainer (42) is formed of the polymer actuator (50) in the present embodiment, but only part of the guiding part (42*b*) may be formed of the polymer actuator (50). In other words, the polymer actuator (50) may be employed in any part of the guiding part (42*b*) only within a range capable of changing the curve of the guiding part (42*b*) through change in at least the warp amount of its own.

Other Embodiments

The present invention may have any of the following constructions in each of the above embodiments.

For example, the compressor (1) of generally called rotary piston type is employed in each of the above embodiments, but the present invention may be applied to any compressors of generally-called swing piston type, scroll type, or the like. In sum, the present invention is applicable to any compressor in which the reed valve (41) and the valve retainer (42) are provided at the discharge port (29) of the compression chamber (25*b*) as an operation chamber.

Further, in each of the above embodiments, only either of the valve fixing part (42*a*) and the guiding part (42*b*) of the valve retainer (42) is formed of the polymer actuator (50). In the present invention, however, both of them may be formed of the polymer actuator (50). In other words, it is possible that polymer actuators (50) are employed in both the valve fixing part (42*a*) and the guiding part (42*b*) and are separately controlled to vary in shape so that the rigidity and the lift amount of the reed valve (41) are controlled simultaneously. In this case, various controls in response to the operation speed are enabled, improving in operation efficiency.

Moreover, in Embodiment 1, the fixed length of the reed valve (41) is changed by expansion or contraction of the polymer actuator (50). The present embodiment is not limited thereto and the valve fixing part (42*a*) may be changed by the polymer actuator (50) in any way capable of changing the rigidity of the reed valve (41).

Furthermore, in Embodiment 2, the curve of the guiding part (42*b*) of the reed valve (41) is changed by warp and shape variation of the polymer actuator (50). However, the present invention is not limited thereto and the valve part (42*b*) may be changed by the polymer actuator (50) in any way capable of changing the lift amount of the valve part (41*b*) of the reed valve (41).

In addition, in each of the above embodiments, the shape varying member is composed of the polymer actuator (50). However, in the present invention, any actuator capable of varying in shape by external input force such as voltage application may be employed.

INDUSTRIAL APPLICABILITY

As described above, the present invention is useful for a compressor for compressing any kind of fluid.

What is claimed is:

1. A compressor comprising:

a compression mechanism configured to compress fluid, the compression mechanism including a discharge port;

a reed valve; and a valve retainer for the reed valve coupling the reed valve at the discharge port, at least part of the valve retainer being composed of a shape varying member that varies in shape in response to a voltage application so as to change an a rigidity of the reed valve, the valve retainer including a valve fixing part for fixing a fixed part of the reed valve and a curved guiding part for restricting a valve part of the reed valve to a lift amount, at least part of the valve fixing part forming the shape varying member so as to change a rigidity of the reed valve, and the shape varying member of the valve fixing part expanding or contracting in length so as to change a length of the fixed part of the reed valve.

2. The compressor of claim 1, wherein the shape varying member is formed of a polymer actuator.

3. A compressor, comprising:

a compression mechanism configured to compress fluid, the compression mechanism including a discharge port;

a reed valve; and a valve retainer for the reed valve coupling the reed valve at the discharge port, only part of the valve retainer being composed of a shape varying member that varies in shape in response to a voltage application so as to change a rigidity of the reed valve, the valve retainer including a valve fixing part for fixing a fixed part of the reed valve and a curved guiding part for restricting a valve part of the reed valve to a lift amount, at least part of the valve fixing part forming the shape varying member so as to change a rigidity of the reed valve, the shape varying member of the valve fixing part expanding or contracting in length so as to change a length of the fixed part of the reed valve.

4. The compressor of claim 3, wherein the shape varying member is formed of a polymer actuator.

* * * * *